US007916041B2

(12) United States Patent
Downton

(10) Patent No.: US 7,916,041 B2
(45) Date of Patent: Mar. 29, 2011

(54) HOLE DEPTH SENSING

(75) Inventor: Geoff Downton, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 768 days.

(21) Appl. No.: 11/959,645

(22) Filed: Dec. 19, 2007

(65) Prior Publication Data

US 2008/0165026 A1 Jul. 10, 2008

(30) Foreign Application Priority Data

Jan. 4, 2007 (GB) ..... 0701237.0

(51) Int. Cl.
*G01V 3/00* (2006.01)

(52) U.S. Cl. ..... 340/854.1; 175/61; 702/166

(58) Field of Classification Search ..... 340/854.1; 175/61; 702/166
See application file for complete search history.

(56) References Cited

U.S. PATENT DOCUMENTS

| | | | | |
|---|---|---|---|---|
| 3,931,735 | A * | 1/1976 | Guigmard | 73/152.45 |
| 4,512,186 | A * | 4/1985 | Edwards | 73/152.45 |
| 4,616,321 | A | 10/1986 | Chan | |
| 4,976,143 | A * | 12/1990 | Casso | 73/152.45 |
| 5,107,705 | A * | 4/1992 | Wraight et al. | 73/152.03 |
| 5,419,405 | A * | 5/1995 | Patton | 175/27 |
| 5,469,916 | A | 11/1995 | Sas-Jaworsky et al. | |
| 5,896,939 | A | 4/1999 | Witte | |
| 6,563,303 | B1 * | 5/2003 | Watkins | 324/206 |
| 2003/0056381 | A1 * | 3/2003 | Brosnahan et al. | 33/313 |
| 2006/0015257 | A1 * | 1/2006 | Hassan et al. | 702/6 |
| 2008/0105423 | A1 * | 5/2008 | Estes et al. | 166/250.01 |

* cited by examiner

*Primary Examiner* — Timothy Edwards, Jr.
(74) *Attorney, Agent, or Firm* — Vincent Loccisano; Jeremy Welch; Brigitte Echols

(57) ABSTRACT

A method of sensing and transmitting hole depth information comprises monitoring, at the surface, the extension of the hole as drilling progresses, determining when the hole depth has extended by a predetermined distance, and sending an increment signal to a telemetry device.

6 Claims, 1 Drawing Sheet

HOLE DEPTH SENSING

BACKGROUND TO THE INVENTION

This invention relates to the sensing of the depth of a borehole as the borehole is being formed in a formation.

It is well known to use steerable drilling systems in the formation of boreholes to permit control over the drilling direction, and hence the direction in which the borehole is extended. By appropriate control over the steerable drilling system, the borehole can be drilled along substantially a predetermined, planned route.

When a curve or dog leg is formed in a borehole, the severity or sharpness of the curve is conventionally expressed in units of degrees/100 ft, and the steerable drilling systems used are designed to achieve deflection of the borehole away from it previous centreline as the borehole is extended.

In order to control the operation of such steerable drilling systems it is important to know the depth of the borehole, and to be able to transmit such depth information to the control system of the steerable drilling system. In the past, this has been done by continuously measuring the absolute hole depth at the surface and transmitting this information to the downhole components of the steerable drilling system. The regular or continuous transmission of hole depth information in this manner uses up a significant part of the available data transmission capacity and so is undesirable.

SUMMARY OF THE INVENTION

According to the invention there is provided a method of sensing and transmitting hole depth information comprising monitoring at the surface the extension of the hole as drilling progresses, determining when the hole depth has extended by a predetermined distance and sending an increment signal to a telemetry device.

Using such a system, transmission capacity is only used periodically when it is determined that the hole depth has been increased by a predetermined distance, say of 0.5 m.

The telemetry device may transmit the increment signal to a downhole tool using a range of techniques, for example by modulation of the drilling fluid pressure or flow rate, by variation of the applied weight-on-bit load or by variation of the applied torque.

Monitoring the extension of the hole can be achieved by monitoring, at the surface, the introduction of drilling pipe into the borehole.

BRIEF DESCRIPTION OF THE DRAWINGS

The invention will further be described, by way of example, with reference to the accompanying drawing, in which.

DETAILED DESCRIPTION OF THE DRAWINGS

Figure 1:
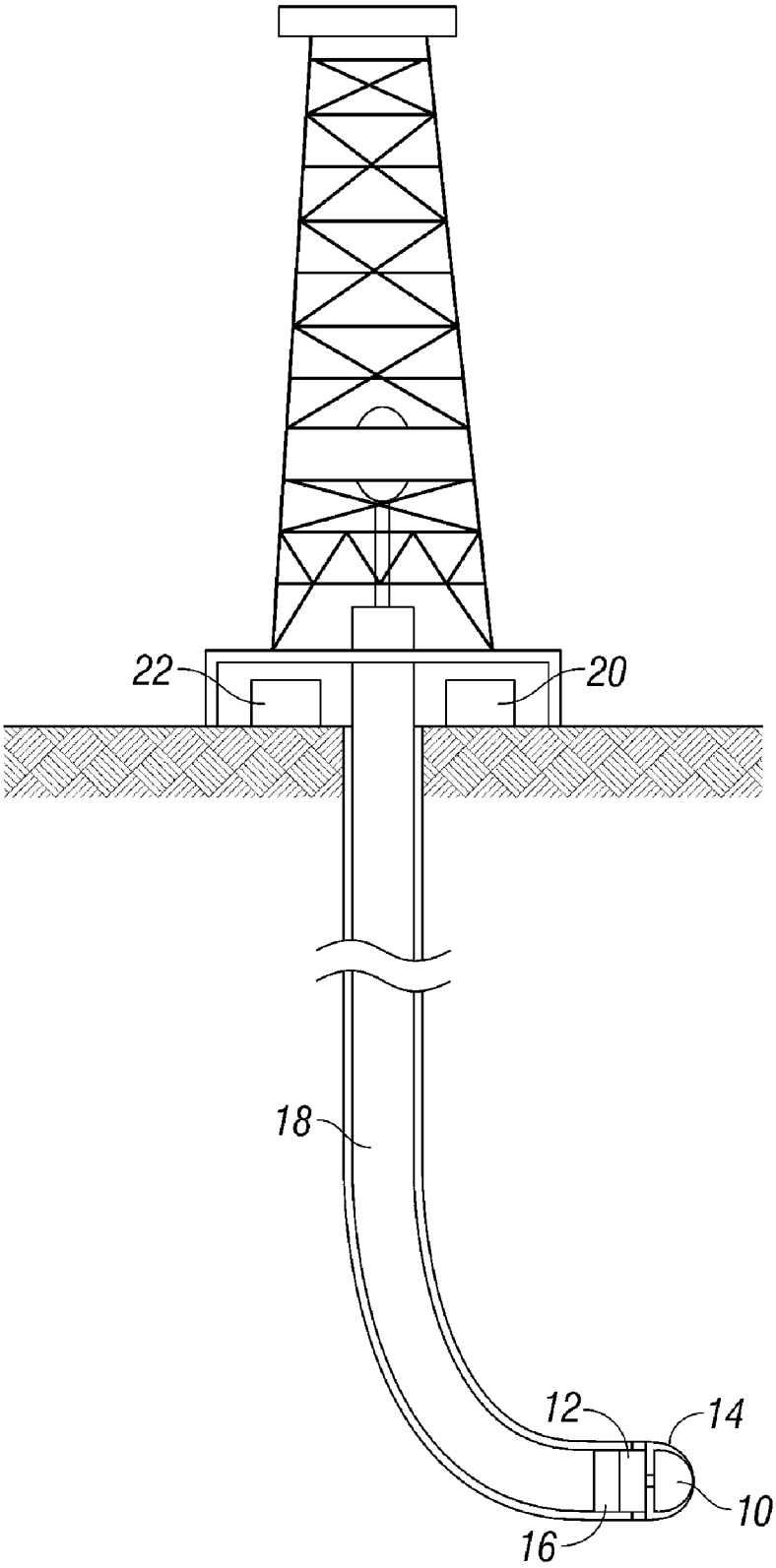
FIG. 1 is a diagrammatic representation of a drilling system embodying the depth sensing arrangement of the invention.

Referring to FIG. 1 there is illustrated, diagrammatically, a drilling system comprising a bottom hole assembly including a drill bit 10 connected to a bias unit 12 of a steerable drilling system. A downhole motor, or a surface located motor, is used to rotate the bit 10 whilst a weight-on-bit loading is applied thereto to cause the bit to gouge, scrape, abrade or otherwise remove formation material to extend the length of the borehole 14 being formed.

The bias unit 12 has a control unit 16 associated therewith, the control unit 16 controlling the bias unit 12 using information derived from sensors regarding, for example, the azimuth and inclination of the borehole 14, the orientation of the bias unit 12 and information relating to the desired path along which the borehole is to be formed. The control unit 16 is carried by a drill string made up of sections of drill pipe 18 which are secured to one another in an end-to-end configuration and inserted into the top of the borehole 14 as the borehole 14 extends during drilling. If it is assumed that the drill bit 10 is at the bottom of the borehole 14, then with knowledge of the dimensions of the bottom hole assembly and knowledge of the number and length of the drill pipe sections which have been used, the length of the borehole can be calculated.

In order to control the operation of the bias unit 12, the control unit 16 requires information representative of the length or depth of the borehole 14, or at least representative of changes in the length or depth as drilling takes place. In order to provide this information, the length of the drill pipe, and the rate of increase thereof, is monitored by a surface located sensor 22 and an increment signal is produced each time the length of the drill pipe is increased by a predetermined amount. For example, the increment signal may be produced each time the drill pipe length is increased by 0.5 m. The increment signal is input to a telemetry transmitter device 20 located at the surface, in this embodiment, which is arranged to transmit a similar increment signal to the control unit 16 each time it receives an increment signal from the sensor 22. Although illustrated as located at the surface, the telemetry transmitter device 20 could be located elsewhere.

A number of different techniques may be used to transmit the signal from the transmitter device 20 to the control unit 16. For example, it may be transmitted by modulation of the drilling fluid pressure, by variation of the drilling fluid flow rate, by variation of the applied weight-on-bit load or by variation of the applied torque. It will be appreciated, however, that the other transmission techniques may be used. In each case, the control unit 16 is provided with sensors sensitive to the parameter used to transmit the signal.

In use, each time the control unit 16 receives a signal indicative of the drill pipe length having increased by the predetermined increment, the control unit 16 knows that its position has changed by the predetermined increment, and calculates a new direction in which to steer drilling. Using the newly calculated direction, the control unit 16 continues to control operation of the bias unit 12.

Obviously, the increment signal is only meaningful if, at the time the signal is generated, the bottom hole assembly is at the bottom of the hole, rather than spaced therefrom. Conveniently, therefore, the bottom hole assembly incorporates one or more sensors arranged to output a signal indicative of whether or not the bottom hole assembly is actually at the bottom of the borehole 14 and drilling ahead, the output of these sensors being supplied to the control unit 16.

When new lengths of drill pie are added, it is common for the bottom hole assembly to be lifted from the bottom of the borehole 14. As this will often occur between the transmission of increment signals, and as the drill pipe may stretch, there may be some discrepancy between the increment signal information—the actual distance drilled between the last increment signal transmitted before drilling was interrupted and the first signal received after recommencement of drilling may not equate to the predetermined increment distance. Although for a short period of time this may result in the control unit 16 failing to control drilling in precisely the desired manner, upon receipt of the second increment signal after resumption of drilling, correct control is re-established. Further, even in the short period of time over which the increment signals may provide incorrect depth information, the use of sensed azimuth and inclination data can be used to infer the actual hole depth.

As mentioned hereinbefore, one significant advantage of the invention is that depth information need only be transmitted intermittently, rather than continuously, to the control unit, thus the data transmission capacity allocated to the transmission of depth information is significantly reduced.

It will be appreciated that a wide range of modifications and alterations may be made to the arrangement described hereinbefore without departing from the scope of the invention.

The invention claimed is:

1. A method of sensing and transmitting hole depth information comprising monitoring, at the surface, the extension of the hole as drilling progresses, determining when the hole depth has extended by a predetermined distance, and sending an increment signal to a telemetry device.

2. A method according to claim 1, wherein the said predetermined distance is 0.5 m.

3. A method according to claim 1, wherein the telemetry device is arranged to transmit the increment signal to a downhole tool by modulation of the drilling fluid pressure or flow rate, by variation of the applied weight-on-bit load or by variation of the applied torque.

4. A method according to claim 3, where the downhole tool is arranged to calculate a new drilling trajectory upon receipt of the increment signal.

5. A method according to claim 1, wherein the extension of the hole is monitored by monitoring, at the surface, the introduction of drilling pipe into the borehole.

6. A method according to claim 1, further comprising a sensor adapted to sense whether a bottom hole assembly is located at the bottom of the borehole.

* * * * *